United States Patent [19]

Liebel

[11] Patent Number: 4,591,519

[45] Date of Patent: May 27, 1986

[54] CARGO AIR BAG

[75] Inventor: Henry L. Liebel, Cincinnati, Ohio

[73] Assignee: Signode Paper Products Company, Cincinnati, Ohio

[21] Appl. No.: 734,669

[22] Filed: May 16, 1985

[51] Int. Cl.[4] ..... B61D 45/00; B65D 81/02

[52] U.S. Cl. ..... 428/35; 410/119; 410/125; 206/522; 428/68; 428/126

[58] Field of Search ..... 410/119, 118, 117, 125, 410/124, 127, 128; 206/522; 428/35, 68, 69, 78, 126, 127, 128, 129

[56] References Cited

U.S. PATENT DOCUMENTS

| | | | |
|---|---|---|---|
| 3,028,981 | 4/1962 | Ford et al. | 410/125 |
| 3,072,270 | 1/1963 | Tolby et al. | 410/119 |
| 3,506,143 | 4/1970 | Evans | 206/522 |

*Primary Examiner*—John E. Kittle
*Assistant Examiner*—Thomas C. Saitta
*Attorney, Agent, or Firm*—Wood, Herron & Evans

[57] ABSTRACT

An air bag for bracing product shipped by a railcar, trailer or overseas container to prevent lengthwise and/or crosswise movement of the cargo. The air bag includes a first sheet of paperboard having parallel side and end edges folded inwardly defining a planar center section and overlapping sides and ends, a second sheet of paperboard of the same dimension as the center section facing the center section and having its marginal side and end edges interposed between the center section and the overlapping side and end sections of the first sheet and glued to the side and end sections, and an inflatable bladder between the two sheets. The bag is constructed of relatively stiff paperboard of a minimum of two laminated plys. Thus, the overlapping side and end edges of the first sheet define with the second sheet a peripheral border of a minimum of six laminated plys of paperboard. The bag has relatively good vertical stiffness when uninflated making it easy to use. The air bag is further characterized by its ease and economy of manufacture.

1 Claim, 4 Drawing Figures

CARGO AIR BAG

BACKGROUND OF THE INVENTION

This invention relates to cargo air bags and, more particularly, to an improved construction of a cargo air bag providing improved strength, stiffness, ease of use and economies of manufacture.

It is known in the art to use inflatable air bags as bracing to reduce damaged product, materials, labor and loading time in shipping cargo. Such bags are typically comprised of a plastic inflatable bladder which is surrounded by a multi-walled paper bag to protect the bladder from puncture. An inflation valve extends through the air bag and into the bladder such that the bladder may be filled and expanded with compressed air. The size of the multi-walled bag is such that it expands under the internal pressure of the gas. Such bags are manufactured in a variety of sizes to fill virtually any load pattern and void size and shape in the shipping of products.

In use, product to be shipped, for example, via railcar, trailer or overseas container, is placed in the container. Typically, the load does not fill the container completely and adjacent loads may be spaced from each other or spaced from the ends and side walls of the container. Without bracing of the load, the load would be subject to movement during shipping. The use of air bags prevents lengthwise and/or crosswise movement of such cargo so that the construction of bulkheads is not necessary. In use, an air bag is placed in the void between spaced pallets or load units or between the side or end walls of the container and the load. Thereafter, an operator inflates the bag with compressed air, the bladder and bag expanding to thereby fill the void and brace the load. To remove the load, it is only necessary to simply puncture the air bag so that it can deflate and remove it from the container. Air bags thus provide a fast and easy way to brace a load for shipment.

Today, air bags are typically manufactured by taking a length of multiple-layered paper, folding it on itself at its edges to form an overlapping seam generally along the centerline and then gluing the overlapping edges together. There is thus formed a multi-walled paper tube having open ends. The inflatable plastic bladder is then inserted in the tube by holding the tube up at both ends to expand it and sliding the bladder into the expanded tube. The ends of the bag are then closed and sealed to form the completed air bag.

The construction of these air bags is relatively labor intensive, it being difficult to insert the bladder in the bag in the manufacturing process. Further, this operation of inserting the bladder in the paper tube typically has to be carried out by hand. Still further, in construction of multi-walled air bags of this type, it is necessary to fold the paper on itself which weakens the paper fibers along the folded edges. Experience has shown that if there is a blowout of the bag because of the air pressure in the bag, the blowout typically occurs at the folded edge of the bag where the fibers have been weakened. Further, such air bags typically do not have vertical stiffness. Thus, when placed between the load by the operator, the paper bag tends to sag toward the floor, and the operator must attempt to hold the bag upright while at the same time inflate it. This can be an awkward operation.

SUMMARY OF THE INVENTION

It has been among the principal objectives of this invention to provide an improved cargo air bag which is more easily manufactured than those heretofore available, which has increased resistance to blowout, good abrasion resistance, and which has a high degree of vertical stiffness making its inflation when placed in the void between spaced loads or between the load and container walls faster and easier.

In accordance with a presently preferred embodiment of the invention, the cargo air bag is composed of a first sheet of relatively stiff paperboard which is folded on itself along opposed parallel side and end edges to thereby define a planar center section having folded and overlapping side and end sections. A second sheet of relatively stiff paperboard having a length and width corresponding to the length and width of the center section of the first paperboard sheet faces the center section of the first sheet with its side and end edges underneath the overlapping side and end sections of the first sheet. The inner surfaces of the overlapping sections are glued to the marginal side and end edges of the second sheet of paperboard.

An inflatable plastic bladder lies between these two sheets. An inflation valve extends through the first sheet permitting inflation of the bladder.

The two sheets are formed of a minimum of two plys of laminated paperboard. Thus, the folded side and end sections of the first sheet define with the interposed side and end sections of the second sheet a peripheral border of a minimum of six laminated plys. This provides the air bag with good strength and excellent vertical stiffness such that the air bag is essentially self-supporting in the void permitting its ready inflation by a single worker.

The manufacture of the air bag of the present invention is relatively simple. The first sheet is placed on a flat surface. A plastic bladder is laid on the center section of the first sheet and the second sheet is placed thereover. The side and end sections of the first sheet are folded inwardly. The folded side and end edges are glued to the second sheet. The overlapping sections are then and pressed together to form the completed structure. Thus, in the manufacture of the air bag of the present invention, it is not required to open a paper bag and manually insert a bladder therebetween. Moreover, it has been found that by the nature of the construction of the bag, including the six ply layer thickness of paperboard at the edges, the bag has a significant resistance to blowout. Still further, as stated, the laminated paperboard layers at the ends of the two sheets which extend in a vertical direction in use provide an air bag having a relatively high degree of stiffness in the vertical direction. Thus, it may be placed in the void between loads and will not sag or flop down before inflation making its positioning and inflation easy and fast.

DETAILED DESCRIPTION OF THE INVENTION

Figure 1:
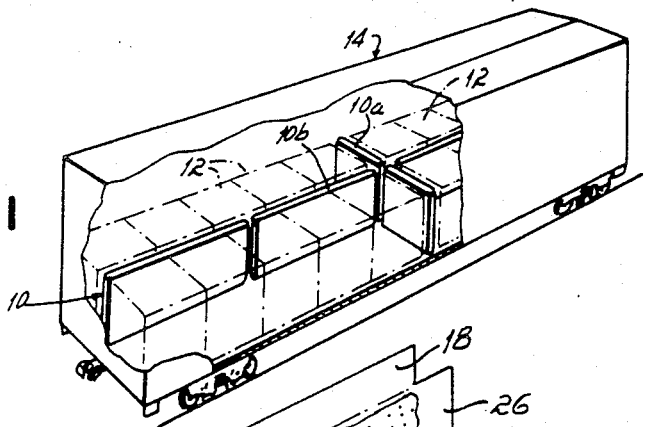
FIG. 1 is a pictorial view with parts broken away of a railcar illustrating the environment in which the air bag of the present invention is used.

Referring to FIG. 1, cargo air bags 10 keep cargo 12 shipped in containers 14 such as trailers, overseas containers and railcars tightly braced both laterally and lengthwise to prevent its movement or shifting during transport, a railroad car 14 being illustrated in FIG. 1. For purposes of understanding the environment in which air bags are used, it may be observed that bags 10*a* provide lengthwise bracing of cargo 12 in a railroad car 14 by compacting and positioning the load toward the end walls thus eliminating lengthwise voids. They also cushion loads upon impact by absorbing shocks. The air bags also enlarge to fill voids that occur when cargo settles.

Bags 10*b* positioned between lengthwise rows of lading fill the voids in the crosswise direction holding the product firmly against the side walls. The air pressure in the bags exerts constant pressure on the load so that it is constrained against the side walls. The air bags thus prevent side shifting of the load.

Figure 2:
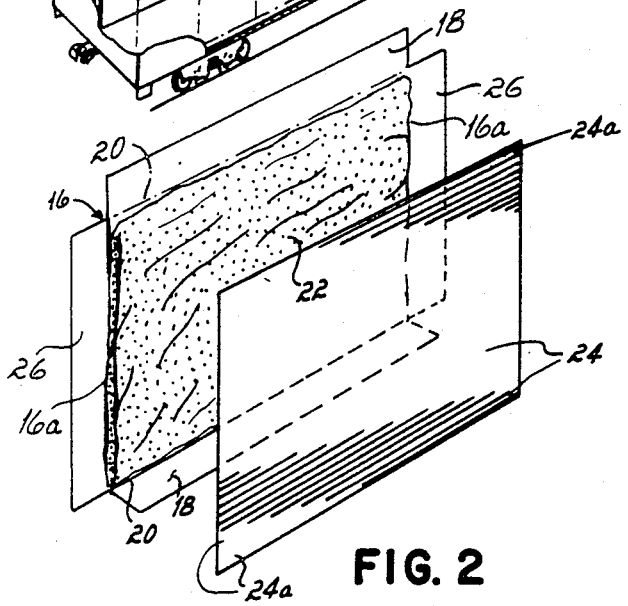
FIG. 2 is an exploded view of the air bag of the present invention.

Referring now to FIG. 2, the air bag of a presently preferred form of the invention comprises two paperboard elements. In the manufacture of the air bag, a first sheet 16 of paperboard having a lengthwise and widthwise direction includes opposed side and end edges or flaps to be folded inwardly along its lengthwise and widthwise directions, respectively, to form two folded side sections 18 and two folded end sections 26. The fold lines 20 of the side sections 18 and end sections 26 define a generally planar center section 16*a* having a defined length and width. The folded side and end sections 18 and 26, respectively, overlap portions of the center section 16*a*.

Figure 3:
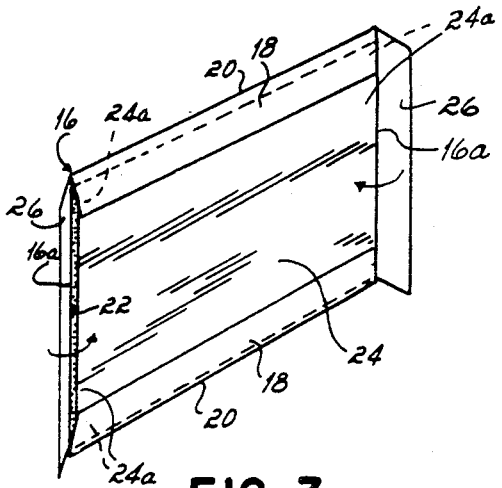
FIG. 3 is a pictorial view illustrating a step in the manufacture of the air bag.

An inflatable plastic bladder 22 is laid on the center section 16*a* of the first paperboard sheet 16. A second sheet 24 of paperboard having a length and width corresponding generally to that of the center section 16*a* of the first sheet 16 is placed on the bladder with marginal side and end portions 24*a* (FIGS. 2, 3 and 4) lying under the overlapping side and end sections 18 and 26 of the first sheet 16. The side and end sections 18 and 26 are glued to the side and end portions 24*a* of the second paperboard sheet and the two members pressed together. The first and second sheets are at least two ply laminated paperboard. In a presently preferred embodiment, each sheet has a thickness in the range of 0.022–0.024 inches.

Figure 4:
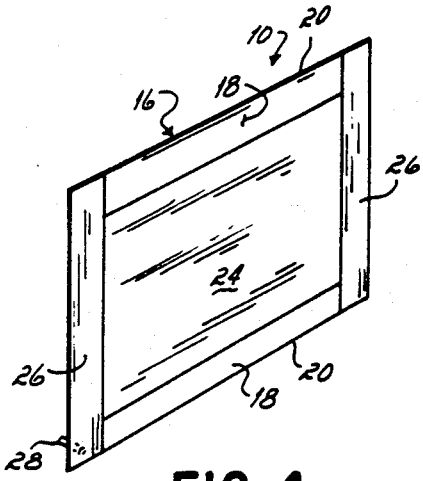
FIG. 4 is a pictorial view showing the completed bag before inflation.

As may be seen with reference to FIG. 4, the air bag 10 thus comprises first 16 and second 24 sheets of paperboard with folded side edges 18 and end edges 26 of the first sheet 16 laminating edge portions 24*a* of the section sheet 24 therebetween with an internal bladder enclosed therein. An inflation valve 28 extends through the first sheet permitting inflation of the plastic bladder with compressed air.

The manufacture of the air bag of the present invention thus considerably reduces the time and labor required in manufacture. That is, since it is not necessary to position a deflated plastic bag in an open paper tube but rather merely to lay it on the surface of first sheet 16 and then lay the second sheet 24 on the bladder, this operation can be carried out very simply and with considerably less space requirements than heretofore required.

In addition, the air bag is relatively strong since it comprises six plys of laminated paperboard at the peripheral border of the bag. Still further, the six plys at the ends 26 provide the air bag with a relatively high degree of vertical stiffness such that it can be positioned in the voids and will support itself in a vertical direction while uninflated making inflation thereof considerably easier.

Thus having described the invention, what is claimed is:

1. An air bag for filling a void in the loading of cargo comprising:

a first sheet of at least two plys of laminated paperboard including a generally planar center section and a pair of side and end sections hinged to said center section along fold lines corresponding to the lengthwise and widthwise edges of said center section, respectively, a second sheet of at least two plys of laminated paperboard substantially congruent to said planar center section of said first sheet and facing it, the marginal side edges of said second sheet being interposed between said side and end sections of said first sheet folded thereover in overlapping relation and being adhered thereto, and an inflatable bladder between said second sheet and the center section of said first sheet, the overlapping side and end sections of said first sheet capturing therebetween the peripheral side and end portions of said second sheet defining therewith a peripheral border of at least six plys of laminated paperboard in thickness, said air bag being sufficiently stiff that said air bag is substantially self-supporting in said void in the uninflated condition.

* * * * *